US005692979A

United States Patent [19]

Jones

[11] Patent Number: 5,692,979

[45] Date of Patent: Dec. 2, 1997

[54] MULTI-PURPOSE GAME DEVICE

[76] Inventor: George D. Jones, 9210-5th St., Lanham, Md. 20706

[21] Appl. No.: 749,633

[22] Filed: Nov. 15, 1996

[51] Int. Cl.[6] ..... A63B 63/04

[52] U.S. Cl. ..... 473/470; 273/400; 273/401; 473/197; 473/471; 473/472; 473/485

[58] Field of Search ..... 473/470, 471, 473/472, 476, 479, 485, 196, 197, 446; 273/398, 400, 401, 402

[56] References Cited

U.S. PATENT DOCUMENTS

| | | | |
|---|---|---|---|
| 154,784 | 9/1874 | Bogia . | |
| 611,504 | 9/1898 | Perky | 273/400 |
| 715,249 | 12/1902 | Dunbar . | |
| 1,270,654 | 6/1918 | Overbury . | |
| 1,279,654 | 9/1918 | Charlesworth | 273/461 X |
| 1,979,584 | 11/1934 | Thompson . | |
| 2,247,852 | 7/1941 | Saunders | 273/400 X |
| 3,348,846 | 10/1967 | Atchison | 473/196 |
| 3,467,388 | 9/1969 | Weiler | 473/196 |
| 4,053,155 | 10/1977 | Williams . | |
| 4,111,422 | 9/1978 | Burcenski . | |
| 4,295,650 | 10/1981 | Keeble | 273/118 R |
| 4,358,116 | 11/1982 | Florida | 473/196 X |
| 4,358,160 | 11/1982 | Kissell et al. . | |
| 4,826,177 | 5/1989 | Ponte | 273/400 |
| 5,007,637 | 4/1991 | Foley | 473/487 |
| 5,217,230 | 6/1993 | Judd | 473/416 |
| 5,411,265 | 5/1995 | Falco | 473/196 |
| 5,441,267 | 8/1995 | Alder | 473/173 |

*Primary Examiner*—William H. Grieb
*Attorney, Agent, or Firm*—Robert Halper

[57] ABSTRACT

A multipurpose game device comprises a stand having a plurality of detachable standards, each standard containg a webbed hoop with a central aperture and a plurality of plastic spider balls with colored streamers. The balls can be tossed into one of the respective targets in the hoops by the designated player or any one of the standards with its hoop can be detached from the stand with the standard being used as a mallet for hitting one of the plastic balls into a hoop positioned on the ground as in golf, or all of the hoops can be stacked together to form a vertical support with a hoop on the elevated stack for playing basketball. Baseball would be played outdoors with four standards forming a diamond. The homeplate standard would be without a hoop and serves to hold the spiderball, which would be hit with a lightweight bat. Football would be played outdoors with two standards and their hoops placed at an appropriate distance to serve as goal posts and miniature hockey would be played indoors using a smooth rectangular plate in place of the hoops, affixed to the stand with special nets attached at each end. A simulated hockey stick would be used for hitting the ball. The plate absent the nets could be used as a writing table.

9 Claims, 3 Drawing Sheets

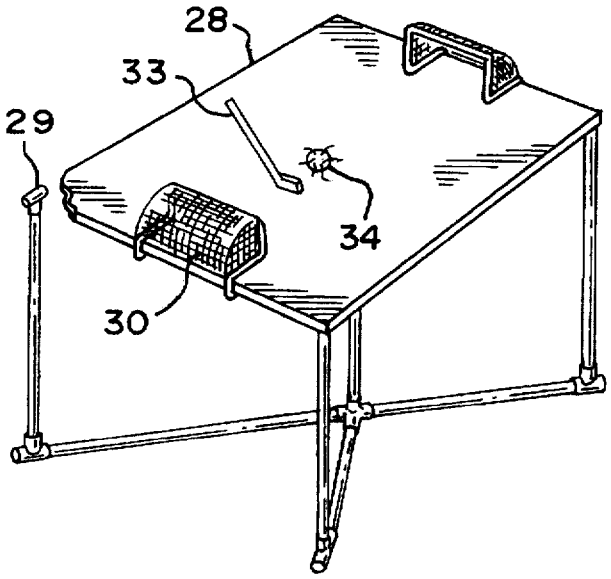
FIG. 6
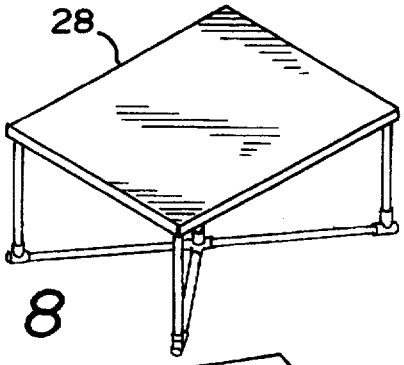
FIG. 8
FIG. 7
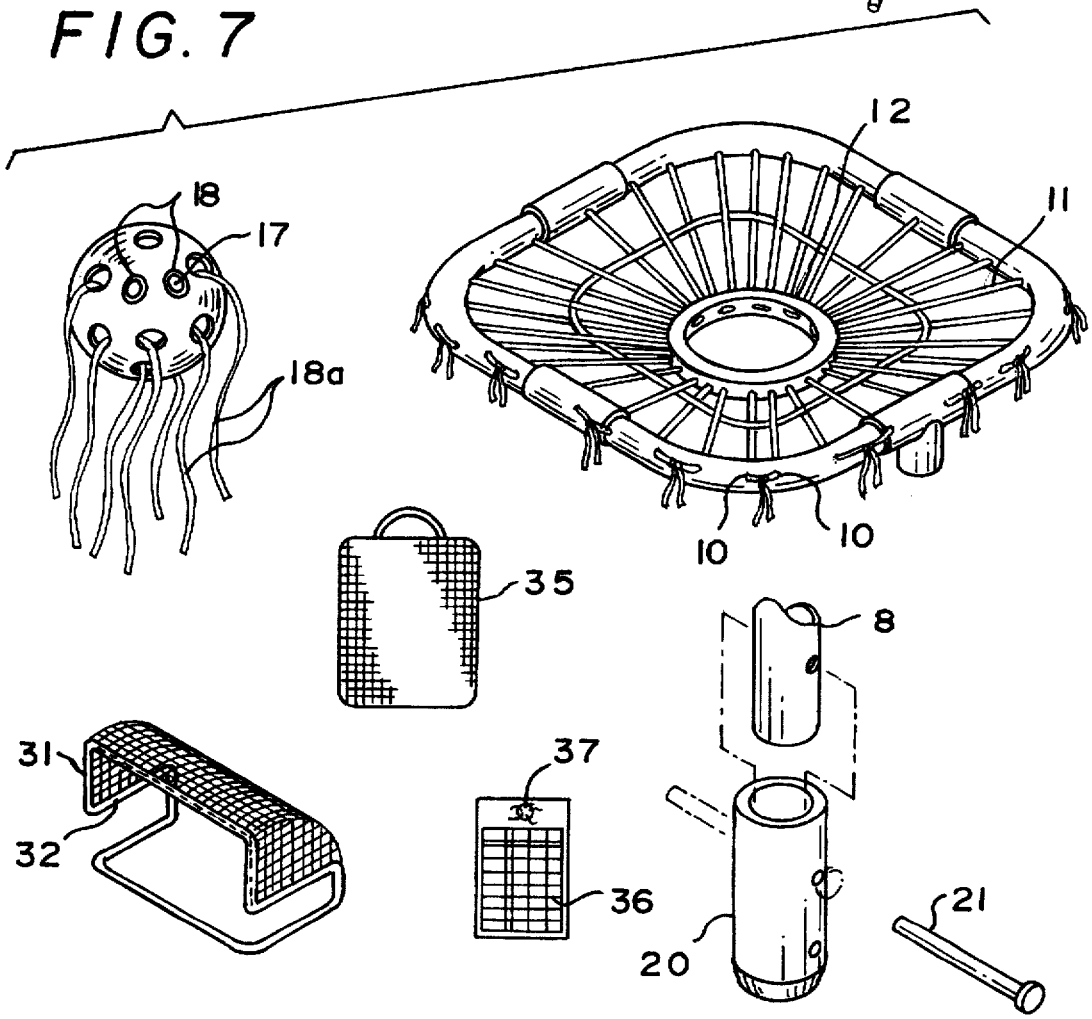

MULTI-PURPOSE GAME DEVICE

FIELD OF THE INVENTION

This invention pertains to a game apparatus, in particular a device that can be used for diversified games.

BACKGROUND OF THE INVENTION

U.S. Pat. No. 154,784 is an early example of a parlor game wherein a mallet is used for driving balls into any one of a array of spaced pockets having sloped faces and radial corrugations.

U.S. Pat. No. 715,249 is a game wherein there is an upper triangular frame connected to another triangular frame by rods. The upper frame is covered by a canvas fastened thereto and has a series of spaced elongated pockets with straight sides The frame is inclined and a projectile in the form of a pad shaped casing filled with loose particles such as shot. The pockets are arranged so that the direction of elongation is aligned with the inclination of the table so that when a person stands some distance from the lower edge of the table the projectile enters the pocket and will pass into the upper extension and on rebounding will fall into the lower extension of the pocket.

U.S. Pat. No. 1,279,654 is similar to the previous patent except that the game board is shown as rectangular and foldable, although it could be any shape and the pockets are shown as cylindrical with a curved bottom and they are made of flexible mesh. Each pocket is numbered to indicate the number of points scored, and the ball can be thrown into one of the pockets or projected by a spring type tool attached to the base on which the game board is supported at an elevated position from the base.

U.S. Pat. No. 1,979,584 shows a game device for use with a golf ball. A plurality of concentric beads is made integral with a rubber mat which is smooth outside of the beads. The beads are beveled and open at the ends to provide a V-shaped opening leading to a center closed ring which is elevated at one end and cut to the shape of a chord at the other end. The mat is cut out in the centermost ring. The mat must be beveled to provide an inclined surface up which the ball is to roll when hit by a golf stick Each bead has a number imprinted on the mat to indicate the score. The golf stick has a counter in the form of a wire member. The game is played indoors or outdoors.

U.S. Pat. No. 2,247,852 is a basketball type game in which a hoop supports a wire mesh bag or bags. Extending from the hoop are a pair of hooks for attaching to a support or the bag could be supported by standards mounted to a base. A rubber ball can be thrown or it can be bounced with enough force so as to rebound into the basket. Also the bags could be attached to a harness and a player catches the bounding ball by positioning his body so that one of the baskets is disposed in the path of the trajectory of the ball The game is played indoors when space is restricted.

U.S. Pat. No. 3,467,388 is a practice device for golf which can be played indoors or outdoors. A basket is positioned horizontally and mounted on a vertical pole which has a pointed edge for fixing in the ground or the pole could be seated on a pedestal. The player can use any one of the golf clubs to hit the ball into the target. A fiat member is placed in various positions to represent different hazards, and if the ball comes to rest thereon, a penalty is exacted.

U.S. Pat. No. 4,053,155 teaches a multiple-game game board that has markers on the game board to show progress of the game and selecting means for determining the position and the quantity of the markers to be located on the game board. The selecting means includes a putting surface with a plurality of targets and a programming means for changing the value of each of the plurality of targets. In some games the value of the target may be the same throughout the game, whereas in other games the value of the targets may be varied periodically throughout the progress of the game. The target will be holes into which a golf ball can fall, so that if a player putts a ball into a hole, then the value of the hole determines the position of the marker. Because of the plurality of targets and the ability to change the value of each target, many games can be played using the same selecting means and though each player practices his putting, a different game is involved to give the players an incentive to play well. Instead of playing golf, a game such as blackjack could be played. The programming devices would now give some indication of a playing card value such as an ace, jack or two. Thus when a player receives 2 cards as in blackjack, he would putt two times, etc. Other games played include poker and anagrams.

U.S. Pat. No. 4,111,422 teaches a lawn game with a plurality of targets in the form of an annular or ring member that defines the frustum of a cone which is supported from the ground surface in a generally upright position by a stake thrust in the ground. A missile is launched toward the target by swinging a launching stick like a golf club. The missile is cylindrical but with a rounded nose, a stabilizing zone at the rear and a plurality of inclined hooks adjacent the forward end for engagement with the launching stick The launching stick includes an elongated handle with a downwardly opening arch at its lower end. A resilient bend extends across the open end of the arch that engages the hooks on the missile. A tee has a pointed peg inserted in the ground with a semicircular cradle for supporting the missile near the forward end. The number of launching sticks and cradle tees depends on the number of players and the lawn area available. The rear of the cylindrical member is provided with a plurality of flexible strips of colored material and made of plastic. The strips form streamers that also help stabilize the missile and assist in observation of flight path.

U.S. Pat. No. 4,295,650 teaches a surface projectile game wih mallets and a plurality of portable 3 sided targets adapted to be positioned in a mutually spaced relationship on a playing surface, each target being characterized by a pair of adjacently related portals arranged in converging horizontal planes and suitably dimensioned for accommodating passing of the ball there through. The ball is propelled in rolling motion by a mallet having a head with ends that have a planar surface less than the cross sectional area of the mallet head.

U.S. Pat. No. 4,358,116 teaches a golf practice target in the form of a closed loop made of a length of lightweight rigid tubing and supported by three soil penetrating legs. The legs are offset so that a golf ball could be passed under the closed loop.

U.S. Pat. No. 5,007,637 teaches a selectively mountable basketball hoop structure. It includes a small scale basketball hoop securable to a door by a bracket. The bracket is of a U shape so as to be mounted over the edge of the door which can be oriented either vertically or horizontally.

U.S. Pat. No. 5,217,230 teaches a multi-sports net tht comprises an elongated main mesh network and a target assembly. There is an opening in the main network at a central location. The target assembly has an annular support member attached to the main network of the net to surround the central opening. The target also has a pouch network with an open end. The multi-sports net can be used for playing different sports such as vollyball, badminton and tennis and as a target for practicing different skills including pitching, throwing, hitting, and kicking balls as employed in tennis, soccer, baseball, softball, etc.

U.S. Pat. No. 5,411,265 is called an aerodynamic golf chipping target. It comprises a disc shaped upper surface and a circumferential portion surrounding the upper surface. In the center of the upper surface is a hole defined by a rim. Beneath the rim there is netting to entrap the ball. The circumferential portion has a gradual slope, whose bottom has a circular opening. Because of the slope the target can be thrown to a designated place and will glide through the air.

Most of the art cited is directed to single games such as golf, basketball or tossing a ball into any one of a number of pockets mounted on a table. One patent cited above uses a multiple game board for playing a variety of different games, although the mechanism of operation for whatever game played is the same, namely golf putting. Another patent uses a single net to play throwing, hitting and tossing games; however, with each different game there is required additional equipment such as balls, bats rackets, etc.

While all these games have merit, there is a need for an assembly that can be manipulated for a plurality of different games, which include a tossing game, a simulated golf, basketball, baseball, football or hockey game, It is an object of this invention to develop a single device which can be adapted to play a plurality of different games.

It is a further object of this invention to develop a device which is adapted to be played indoors or outdoors.

It is still an object of the invention to provide the necessary equipment required to play any of the games.

It is also an object of the invention to provide storage for the equipment when not in use.

SUMMARY OF THE INVENTION

The device of this invention includes all the necessary paraphernalia to play the proposed games. It comprises a stand with a plurality of detachable standards, each containing a webbed hoop with a central aperture and a plurality of plastic, spider balls having colored streamers. Besides tossing the balls into one of the respective targets in the hoops by the designated player, any one of the standards can be detached from the stand and its corresponding hoop and used as a mallet for hitting the plastic balls into one of the detached hoops placed on the ground surface as in golf, or all of the standards can be stacked to form a vertical support for one of the hoops so that one may shoot into a target of the elevated hoop as in basketball. Baseball would be played outdoors with four standards positioned to form a baseball diamond. The three base standards would carry hoops, but the fourth standard serving as home plate would be used to hold the spiderball which would be hit by a batter with an appropriate bat. In playing football outdoors two standards equipped with hoops would be spaced apart at a predetermined distance to serve as goals, and the game would be played as touch football using the spiderball. Miniature hockey would be played indoors using a table fixed on the stand with special hoops attached to both ends of the table and a small simulated hockey stick for hitting the spider ball.

BRIEF DESCRIPTION OF THE DRAWINGS

FIG. 6 shows use of the table mounted on a fixture for playing hockey

FIG. 7 shows in detail some of the accessories used for the different games

FIG. 8 is a perspective view of the table as in FIG. 6, but used for writing such as scores.

DETAILED DESCRIPTION OF THE INVENTION

Figure 1:
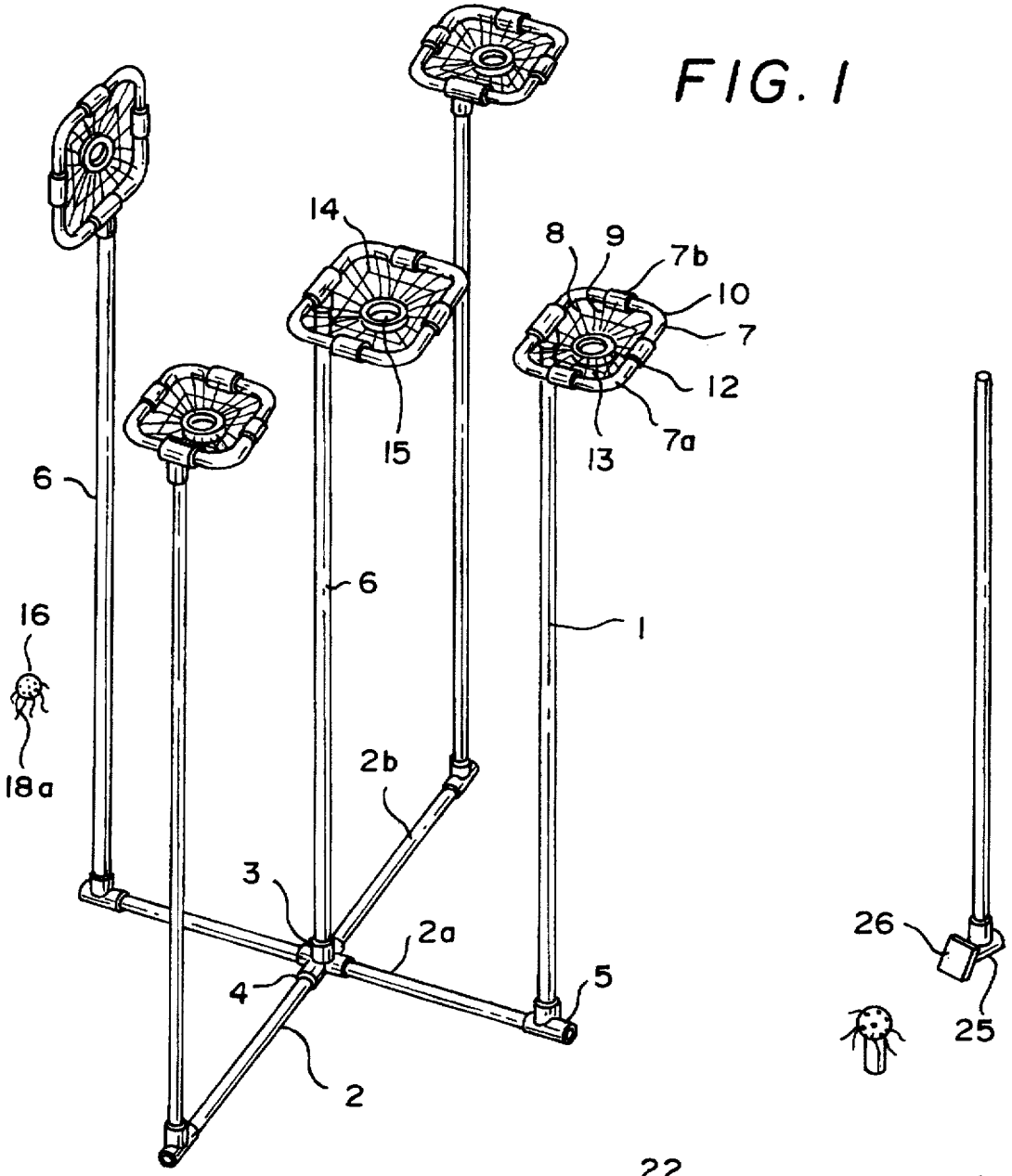
FIG. 1 is a perspective view of the device.
Figure 2:
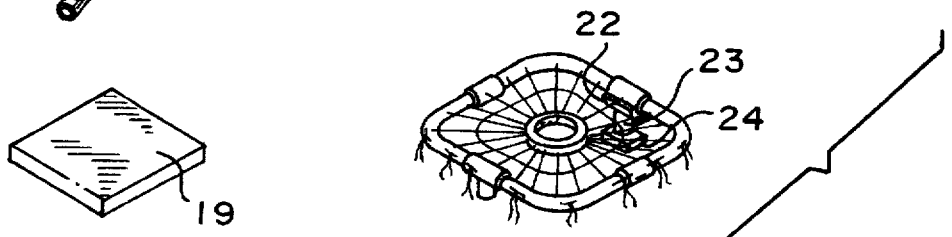
FIG. 2 illustrates a detachment of one or several of the standards for practicing putting or any other hitting game for hitting the ball into the target on a ground surface.
Figure 3:
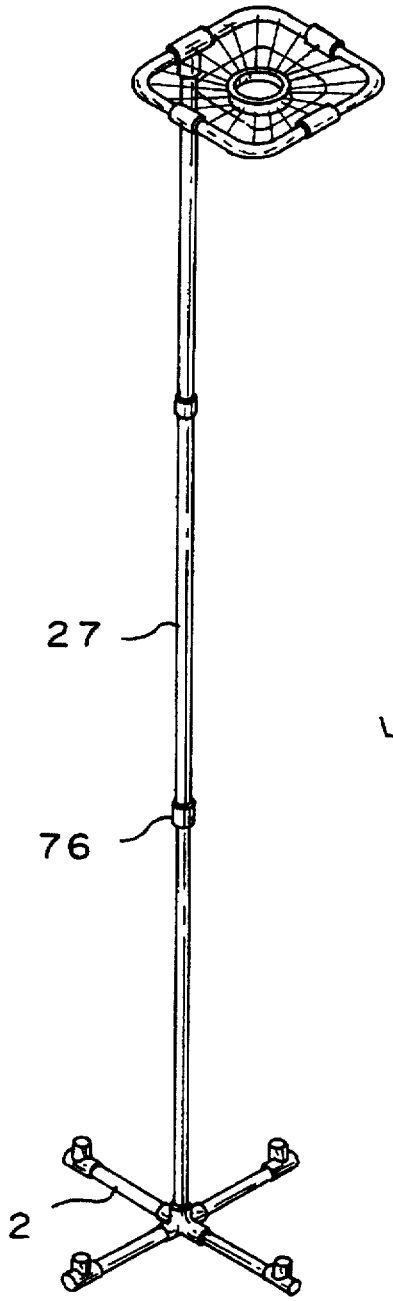
FIG. 3 illustrates erection of the vertical support for playing a basketball type game.
Figure 4:
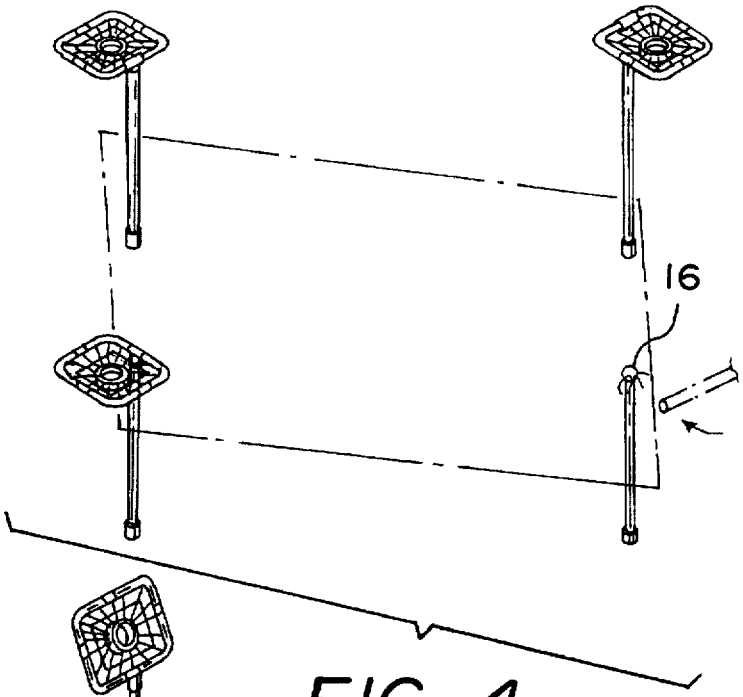
FIG. 4 is illustrative of the arrangement for a baseball game.
Figure 5:
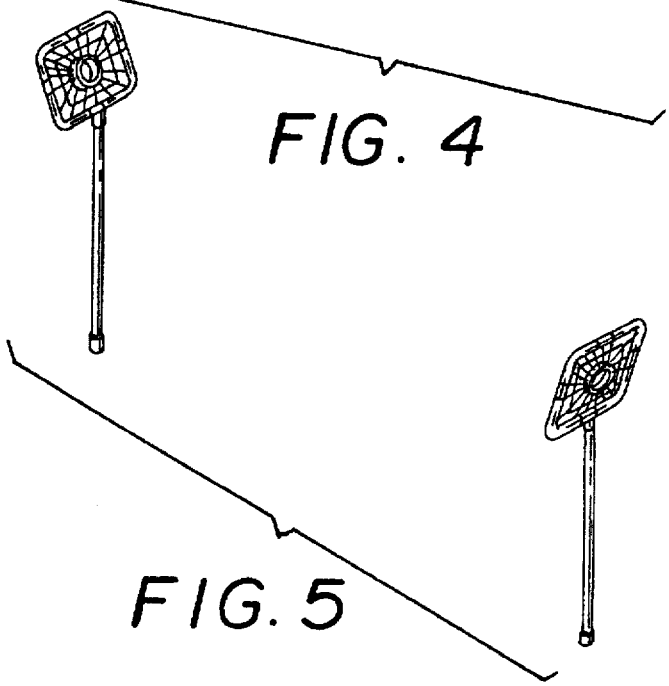
FIG. 5 shows an arrangement for touch football.

FIG. 1 shows a gaming device that includes a stand 1 having a tubular cross member 2. The tubular cross member has tube 2a detachably fastened to a tee 3. This tee has a bore 4 perpendicular to the fastening for tube 2a through which 2b is adhesively secured. On each end of the tubes 2a, 2b, another tee 5 is fastened. Projecting vertically upwardly from each of tees 5 are four tubular standards 6 which surround a central standard that projects upwardly from tee 3. On any four of these standards detachably secured tees 5 are fastened. Passing through these tees are flexible hoops 7. The hoops are split into four equally sized elbows 7a, for insertion into the tee. Two hoop elbows are fastened at one end to the tees by a force fit, while their other ends are force fitted into couplings 7b. Similarly the other two elbows are force fitted into the other ends of the couplings which am perpendicular to the tee. A fourth coupling perpendicular to the tee is used to fasten the other two elbows at their remaining ends. The hoops are removable from the elbows simply by exerting horizontal force, and while generally oriented to be in a horizontal plane can also be set at an angle to the horizontal. Each hoop is fitted with a colored webbing 8 made of a natural or synthetic material such as cotton, wool or rayon. The webbing consists of a series of radial chords 9 The hoop contains a series of spaced perforations 10 on its inner and outer diameter. Starting from one perforation on the outer diameter of the hoop a first end 11 of a chord passes through both perforations of the hoop, then passes, through a perforation in a centrally located rim 12 and on its return passes through an adjacent spaced perforation on the rim, through adjacent spaced perforations on the inner and outer diameter of the hoop and then tied to the other end of the chord. This operation is repeated until all the chords have completely traversed the hoop and the rim to form a net 13, which is slightly inclined from the elevation of the hoop to the rim. The chords forming the net are reenforced by placing a strand of webbing around the net at a point equidistant from the hoop and the rim. This webbing 14 assumes the shape of the hoop and is adhesively fastened to the net by alternatively placing the webbing under and over the net, where it is again knotted on the outside diameter of the hoop. The rim defines an opening 15 which is the ultimate target for any of the above described games to be played. The element that is aimed at the target is a perforated plastic sphere 16 of such a size that it will pass through the target when properly aimed. Two of the perforations will be rifled with rubber washers 17 having a flange 18 that can be pressed into the perforation and serve as eyes for a purpose which will be later explained On the exterior surface of the sphere a plurality of colored streamers 18a made of the same material as the webbing and matching the colors thereof. In playing a tossing game indoors, the stand is set at a predermined distance and each player up to four is assigned a hoop corresponding to the color of the ball. To assure that each player stalls at the same position, a platform 19 is placed at a predetermined position from which each player must toss the ball. The platform can be shaped to suit, for example a rectangular box which is rubberized around the underside of its perimeter. Four games will be played. Since each net will be at a different distance from the platform, the players will change balls after each game so that no one will have any special advantage. The game can be played outdoors in which case each standard is separated from the stand and placed in the ground at a designated spot, determined by one of the players who is chosen to be a monitor. A total of rive games are played and for each game there will be a different monitor. To place the standard in the ground, a hole starter 20 is used. The hole starter is in the form of a small cylinder having one sharpened edge and two vertically spaced holes for the insertion of a pin 21. The hole starter is placed in the ground with a twisting motion. Then a standard is inserted in the hole starter, and the pin is inserted through the hole in the starter and a corresponding hole in the standard The standard is forced further into the ground until a second hole is reached. If necessary some dirt can be tamped sround the standard to secure it.

If a hitting game like golf is to be played, one or all five of the hoops as well as the standards can be disengaged from the stand. The hoops can be placed at random on an indoor or outdoor ground surface. While the tee section on the hoop could be bent to make the hoop level with the ground, it is preferable to fit the hoop at spaced arcuate lengths from the upstanding T-section with a cradle 22 from which extends a vertical leg 23, having a rubber pedestal 24. The standards can be fitted with a modified tee 25 to serve as a golf club. The tee is modified by adhesively binding to one of the parallel ends a plate 26 inclined inwardly and upwardly toward upper joint of the tee. One of the couplings could also serve as a mounting for the ball. To play a basketball type game, all of the standards are stacked in a column 27 using the couplings to connect them with a hoop mounted on the topmost standard. The column can be placed at any appropriate place indoors or outdoors. The column is supported by the tubular cross member 2 as aforementioned. Baseball and football would be played outdoors only. In playing baseball four standards fixed in the ground as explained above, would be laid out as a baseball diamond. The three standards representing the bases would contain the hoops with home plate being a bare standard on which the bell would be placed and another standard serving as a bat. The ball would be placed on the standard so that its eyes would be toward the field. A base runner to be safe on base must keep his hand on the net or the standard. In playing football two standards with hoops attached would be mounted in the ground and spaced apart a predetermined distance. The game would be played as touch football, and the hoops on the standards would be inclined upwardly and rearwardly of the standards. Hockey would be played indoors by using the stand with cross member support. On the top of the standards, instead of the hoops, a plastic rectangular table 28 would be supported by couplings 29 adhesively bound to the table at spaced areas commensurate with the position of the standards. A net 30 fitted over channel supports is slipped around an edge of the table and a corresponding net is slipped over a coincident edge at the other end of the table. The channel supports comprise channel 31 having downwardly extending vertical legs 31 *a*. Adhesively bound to the bottom of the leg of the channel is a channel 32 with legs 32*a* perpendicular to the legs of channel 31. The legs of channel 32 are closely spaced so as to fit snuggly over the edge of the table. The edges of the net are stitched over the channel supports and a specially designed miniature hockey dub 33 and hockey balls 34 will be used. In playing the game each player will alternately shoot for the opposing net. The defense against the player hitting the ball is the small end of the hockey club. Scoring for the different games is determined by the particular game. In a tossing game or basketball, two points are allowed for getting on the net of the hoop and five points if the ball passes through the rim opening. Baseball will be scored as in a conventional baseball game. In football the ball must go through the rim of the net to get a score of 6 points and similarly in hockey each entry in the net will be given a score of 1. When not playing hockey, the stand with the plastic plate can be used as a writing table for tallying scores,etc. When the fixture and the accessories are not in use, they are maintained in a conventional storage bag 35. Score cards 36 having a spider ball insignia 37 and the usual demarcations for names and scores will be printed. All parts of the device are made of plastic except for the webbing and pins. Scoring in any of the games would be as stated above, except that it is to be understood that the players can always modify the scoring to suit.

From the above detailed description, it is readily apparent that features of the described games may be varied and modified and that such changes may be made without departing from the spirit and scope of the invention.

I claim:

1. A multi-purpose game device for playing indoor and outdoor games that comprises:

a) a stand having a base with tubular members secured to each other with a centrally positioned tee having two coincident ends, a pair of tubular members being coincident and fitting into said ends of said tee, a single tubular member perpendicular to said tubular members and passing through a bore in said tee and adhesively fastened around said bore, all of said tubular members having ends extending outwardly from said centrally located tee and further fitted with tees, a standard projecting vertically upwardly from each of said tees, each of said standards having corresponding additional tees at their upward ends, b) flexible hoops having four elbows force fitted into said tees in a plane perpendicular to said vertical standards, said hoops being substantially in the form of a square with oval ends, c) said hoops being fitted with strands of webbing that form radial chords that extend from perforations in said elbows, through perforations in a central rim and then back through adjacent perforations in said hoop, said rim defining a target therein, d) a plurality of perforated spheres small enough to pass through said target and having a number of colored streamers secured thereto, said colors on said streamers macthing colors on said hoops, said spheres being used to play a tossing game, e) said standards being detachable from said base and said hoops, said detachable standards and said hoops being adaptable to play a multiplicity of games other than the games played when said hoops are secured to a stand, f) said hoops per se being detachable from said stand and being replaced by a rectangular plate having an underside to which couplings are adhesively bound, said couplings being located at spaces commensurate with the location of said standards, said couplings force fitted over said standards, said plate having fastened at each end a net, a pair of miniature hockey sticks and a pair of miniature spider balls, the combination of plate, net, balls and sticks being used to play a simulated hockey game, said standards, hoops, balls and said tubular members, when not in use being stored in a weatherproof bag.

2. A multi-purpose game as in claim 1, wherein an outdoor tossing game is played with said detachable standards and hoops attached thereto, said standards being randomly placed in the ground with the aid of a hole starter and a rubberized mat used as a marker from which each player must toss his spider ball into his repective hoop as determined by the color of the streamers attached to said ball.

3. A multipurpose game as in claim 1, wherein a basketball game is played by stacking said standards as a column, said standards being connected together with said couplings, a hoop being fastened to a standard at a top of the column with a tee, said column being supported by said base comprising said tubular members and said column being located at an appropriate place indoors or outdoors.

4. A multipurpose game as in claim 1, wherein an outdoor golf game is played by taking said detached hoops and placing them at random positions on the ground, said tees being oriented to be in a horizontal position, said detached standards being modified to serve as clubs.

5. A multipurpose game as in claim 4 wherein said standards are modified by force fitting a tee at one end thereof, said one end having an inclined plate adhesively bound thereto, said plate being inclined upwardly and inwardly towards the tee opening in which the standard is force fitted.

6. A multipurpose game as in claim 1, wherein a baseball game is played by placing said detached standards in the ground, said standards being arranged to conform to the shape of a baseball diamond, said standards used as bases having said hoops attached thereto and said standard used as home plate being bare and serving as a pedestal for said spider ball, said spider ball having a pair of eyes facing toward said bases, one of said standards functioning as a bat.

7. A multipurpose game as in claim 1 wherein the game of touch football is played outdoors by taking two of said detached standards with said hoops attached and placing said standards in the ground at spaced apart locations to serve as goals, said hoops being inclined rearwardly of said standards.

8. A multipurpose game as in claim 1, wherein said net for playing hockey is fastened to said plate by channel supports, said channel supports having legs that are closely spaced to fit snuggly over said plate, the net having edges stitched over said channel supports.

9. A multipurpose game as in claim 1, wherein said plate fitted over said standards and absent said net is used as a writing table.

* * * * *